US005232581A

United States Patent [19]

Roberts et al.

[11] Patent Number: 5,232,581

[45] Date of Patent: Aug. 3, 1993

[54] RECOVERY OF PLATINUM GROUP METALS AND GOLD BY SYNERGISTIC REACTION BETWEEN ALLYLALKYL THIONOCARBAMATES AND DITHIOPHOSPHATES

[75] Inventors: Dian E. Roberts, Johannesburg; Robert J. Jackson, Randburg, both of South Africa; Alexander S. Lambert, South Glamorgan, United Kingdom

[73] Assignee: American Cyanamid Company, Stamford, Conn.

[21] Appl. No.: 878,249

[22] Filed: May 4, 1992

[51] Int. Cl.[5] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 3,086,653 | 4/1963 | Booth | 209/166 |
| 3,317,040 | 5/1967 | Booth | 209/166 |
| 3,925,218 | 12/1975 | Zipperian | 209/166 |
| 4,040,950 | 8/1977 | Zipperian | 209/166 |
| 4,387,034 | 6/1983 | Unger | 209/166 |
| 4,456,560 | 6/1984 | Lewellyn | 209/166 |
| 4,482,500 | 11/1984 | Lewellyn | 209/166 |
| 4,584,097 | 4/1986 | Fu | 209/166 |
| 4,699,712 | 10/1987 | Unger | 209/166 |
| 4,929,344 | 5/1990 | Fleming | 209/166 |
| 5,082,554 | 1/1992 | Bush | 209/166 |
| 5,094,746 | 3/1992 | Bush | 209/166 |
| 5,147,572 | 9/1992 | Bush | 209/166 |

FOREIGN PATENT DOCUMENTS

| | | | |
|---|---|---|---|
| 6935 | 4/1932 | Australia | 209/166 |
| 1105156 | 7/1981 | Canada | 209/166 |
| 575908 | 4/1933 | Fed. Rep. of Germany | 209/166 |
| 833326 | 6/1981 | U.S.S.R. | 209/166 |
| 914553 | 3/1982 | U.S.S.R. | 209/166 |
| 2106804 | 4/1983 | United Kingdom | 209/166 |

OTHER PUBLICATIONS

XVI International Minerals Processing Congress, Stockholm, Sweden, Jun. 5-10, 1988, Nagaraj et al.

II International Mineral Processing Symposium, Izmir, Turkey, Oct. 4-6, 1988.

Canadian Institute of Mining, Sep. 1987, New Brunswick, N.J.

*Primary Examiner*—Thomas M. Lithgow

*Attorney, Agent, or Firm*—Frank M. Van Riet

[57] ABSTRACT

Collector compositions for use in froth flotation processes for the beneficiation of gold, silver and platinum group values from base metal ores are disclosed. The collector compositions comprise at least one dithiophosphate compound of the formula:

$$(RO)_2\overset{\overset{\displaystyle S}{\|}}{P}S^-X^+ \qquad (I)$$

and at least one allylalkylthionocarbamate of the formula:

$$CH_2{=}CHCH_2NH\overset{\overset{\displaystyle S}{\|}}{C}{-}OR$$

wherein each R is, individually, a $C_2$-$C_8$ alkyl radical. The use of the collector combination provides excellent selective recovery of the gold, silver and platinum group metal values into froth flotation processes conducted under neutral to alkaline conditions.

6 Claims, No Drawings

RECOVERY OF PLATINUM GROUP METALS AND GOLD BY SYNERGISTIC REACTION BETWEEN ALLYLALKYL THIONOCARBAMATES AND DITHIOPHOSPHATES

BACKGROUND OF THE INVENTION

The present invention relates to froth flotation processes for recovery of gold, silver and platinum group metals (PGM) from base metal ores. More particularly, it relates to improved collectors comprising certain synergistic combinations of allylalkylthionocarbamates and dithiophosphates which exhibit an excellent selective recovery of gold, silver and platinum group metals under neutral to alkaline conditions.

Froth flotation is one of the most widely used processes for beneficiating ores containing valuable minerals and is more fully described in U.S. Pat. No. 4,584,097, hereby incorporated herein by reference The success of a flotation process depends a great degree on the reagent(s) called collector(s) that impart(s) selective hydrophobicity to the valuable mineral that has to be separated from other minerals Thus, the flotation separation of one mineral species form another depends upon the relative wetability of mineral surfaces by water. Typically, the surface free energy is purportedly lowered by the adsorption of heteropolar collectors. The hydrophobic coating thus provided acts, in this explanation, as a bridge so that the mineral particles may be attached to an air bubble. The practice of this invention is not, however, limited by this or other theories of flotation.

Xanthates, alkyl xanthogen alkyl formates, bis alkyl xanthogen formates, dialkylthionocarbamates, hydrocarboxycarbonyl thionocarbamates, etc. have been shown to be useful collectors in froth flotation processes. Most of these known collectors, however, are known to suffer from at least one deficiency which prevents them from being used universally for the recovery of metals from each and every ore requiring refining, such as pH dependency, affinity for some metals versus others etc.

The use of mixtures of dithiophosphates and dialkylthionocarbamates as collectors for the recovery of copper from copper-containing ores is taught in U.S. Pat. No. 3,925,218. This patent however, does not include the allyl alkylthionocarbamates nor does it recognize the selectivity of this mixture for gold, silver and platinum group metals.

Accordingly, it is an object of the present invention to provide an improved collector and flotation process for the beneficiation of minerals employing froth flotation methods for the selective recovery of gold, silver and platinum group metals from ore.

SUMMARY OF THE INVENTION

In accordance with the present invention, there is provided a new and improved process for beneficiating gold, silver and platinum group metal containing ores with selective rejection of other metals such as copper and iron, said process comprising: grinding said ore to provide particles of flotation size, slurrying said particles in an aqueous medium, conditioning said slurry with effective amounts of a frothing agent and a metal collector and, frothing the desired minerals preferentially over gangue minerals by froth flotation procedures at a pH ranging from neutral to alkaline, said metal collector comprising a mixture of at least one dialkyldithiophosphate compound selected from compounds having the formula:

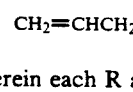

$$(RO)_2PS^-X^+ \quad (I)$$

wherein each R is, individually selected from $C_2$–$C_8$ alkyl radicals and X is a cation, especially alkali metal or alkaline earth metals such as sodium, potassium etc. or ammonium, and at least one allylalkylthionocarbamate compound selected from compounds having the formula:

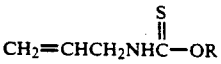

$$CH_2{=}CHCH_2NHC(=S)-OR$$

wherein each R again is a $C_2$–$C_8$ alkyl radical.

The collectors and the process of the present invention unexpectedly provided superior selective gold, silver and platinum group metals recovery in froth flotation separations as compared with many conventional collectors, even at reduced collector dosages, under conditions of neutral to alkaline pH.

Other objects and advantages of the present invention will become apparent from the following detailed description and illustrative working examples.

DETAILED DESCRIPTION OF THE INVENTION

In accordance with the present invention, gold, silver and platinum group metal values are selectively recovered by froth flotation methods in the presence of a novel collector, said collector containing at least one dialkyldithiophosphate compound of the above Formula (I) wherein the R radicals of the dialkyldithiophosphates may independently be selected from ethyl, propyl, n-butyl, t-butyl, isobutyl, n-hexyl, cyclohexyl, heptyl, octyl, groups and the like.

In preferred embodiments, the dialkyldithiophosphate compounds of the above Formula (I) employed are those compounds wherein each R is an isobutyl radical.

Illustrative compounds within the above Formula (I) for use as the collector mixtures in accordance with the present invention include:

sodium diethyl dithiophosphate,
sodium di-t-butyl dithiophosphate,
sodium diisobutyl dithiophosphate,
potassium dioctyl dithiophosphate, and the like.

At least one allylalkylthionocarbamate is also present in said collector mixture wherein the R group of the above Formula II is as indicated for R. Again, the isobutyl derivative is preferred. Illustrative compounds within Formula II, above, include:

N-allyl-O-ethylthionocarbamate;
N-allyl-O-t-butylthionocarbamate,
N-allyl-O-isobutylthionocarbamate;
N-allyl-O-octylthionocarbamate and the like.

In accordance with the present invention, the above-described dithiophosphate-allylalkylthionocarbamate mixtures are employed as collectors in a new and improved froth flotation process which provides a method for enhanced selective beneficiation of gold, silver and platinum group values from ores under neutral to alkaline conditions.

The mixtures of the present invention comprise from about a 5:95 to about a 95:5 volume ratio of dithiophosphate to thionocarbamate, preferably from about a 20:80 to about a 80:20 volume ratio, more preferably from about 35:65 to about a 65:35 volume ratio, respectively.

In accordance with the present invention, the new and improved process for the selective beneficiation of gold, silver and platinum group values from base metal ores comprises, firstly, the step of size-reducing the ore to provide ore particles of flotation size Generally, and without limitation, suitable particle size will vary from between about 5 microns to about 300 microns. Preferably, the ore will be size-reduced to provide flotation sized particles of between about 30 microns to about 200 microns. Especially preferable for use in the present method are base metal ores which have been size-reduced to provide from about 14% to about 30%, by weight, of particles of +75 microns and from about 40% to about 90%, by weight, of particles of −38 microns.

Size reduction of the ores may be performed in accordance with any method known to those skilled in this art.

Preadjustment of pH is conveniently performed by addition of the pH modifier to the grind during the size reduction step.

The pH of the pulp slurry may be preadjusted to any desired value by the addition of lime etc. Thus, for example, excellent selective beneficiation has been obtained in accordance with the process of the present invention at pH values of from about 7.0 to about 12.0, preferably from about 8.0 to about 11.0.

The size-reduced ore, e.g., comprising particles of liberation size, is thereafter slurried in aqueous medium to provide a floatable pulp. The aqueous slurry or pulp of flotation sized ore particles, typically in a flotation apparatus, is adjusted to provide a pulp slurry which contains from about 10 to 60%, by weight, of pulp solids, preferably 25 to 50%, by weight, and especially preferably from about 30% to about 40%, by weight, of pulp solids.

In accordance with a preferred embodiment of the process of the present invention, the flotation of gold, silver and platinum group metals is performed at a pH of from about 8.5 to about 10.0. It has been discovered that in conducting flotation at this pH range, the collectors of the present invention exhibit exceptionally high collector strength, together with excellent collector selectivity, even at reduced collector dosages.

After the pulp slurry has been prepared, the slurry is conditioned by adding effective amounts of a frothing agent and the collector mixture as described above. By "effective amount" is meant any amount of the mixture which provides a desired level of beneficiation of the desired metal values. Generally, about 0.005 to about 0.5 lb. of collector mixture per ton of ore is sufficient.

Any known frothing agent may be employed in the process of the present invention. By way of illustration, such frothing agents as straight or branched chain low molecular weight hydrocarbon alcohols, such as $C_6$ to $C_8$ alkanols, 2-ethyl hexanol and 4-methyl-2-pentanol, also known as methyl isobutyl carbinol (MIBC) may be employed, as well as pine oils, cresylic acid, polyglycol or monoethers of polyglycols and alcohol ethoxylates, to name but a few. Generally, and without limitation, the frothing agent(s) will be added in conventional amounts and amounts of from about 0.01 to about 0.2 pound of frothing agent per ton of ore treated, are suitable.

Thereafter, the conditioned slurry, containing an effective amount of frothing agent and an effective amount of frothing agent and an effective step in accordance with conventional froth flotation methods to float the desired gold, silver and/or platinum group metal values in the forth concentrates and selectively reject or depress other metal values such as copper, iron, etc.

The improved collector mixtures of the present invention may be added to the flotation cell as well as to the grind. The collectors may be added individually or as a mixture per se.

The collector mixtures of the present invention may be used alone or preferably in conjunction with such auxiliary collectors as xanthates, dithiophosphinates, dithionocarbamates, thioureas, mercaptobenzothiazoles, and the like. The auxiliary collectors may be used in amounts up to about 60.0%, by weight, based on the total weight of the mixture of compounds represented by the formulae above, preferably up to about 40%, by weight, same basis.

The following examples are set forth for purposes of illustration only and are not to be construed as limitations on the instant invention except as set forth in the appended claims. All parts and percentages are by weight unless otherwise specified.

EXAMPLE 1

Samples of a platinum ore are removed from the system by accepted means and reduced to minus 1.2 mm. The ore sample is separated into fractions using a samples splitter to ensure equal and representative fractions for further grinding After grinding, the ore is transferred to a conventional flotation machine and diluted to the required solids density. The rotor is set to 1800 rpm with the air valve closed. Freshly prepared reagents are added as follows: Copper sulphate modifier 75 gpt, depressant 75 gpt, and frother 12 gpt with conditioning for 7 minutes. The collector mixture of the invention at 85 gpt and xanthate at 25 gpt are added and conditioned for 0.5 minutes. Rotor rpm is reduced to 1500, air is opened and the concentrate is collected 1 for 3 minutes. Concentrate 2 is collected for 12 minutes, (total 15 minutes) an the concentrates (2) and tailings are filtered, dried and processed for platinum group metal and gold analysis.

This procedure is conducted in triplicate for each reagent addition suite and on three separate occasions. The results are set forth in Table I, below.

TABLE I

| Collectors | | Recovery to | |
|---|---|---|---|
| | | Concentrate 1 | Concentrate 1 + 2 |
| | | Set A | |
| DTP-1 | 100% | 48.89 | 69.72 |
| AAT | 0% | | |
| DTP-2 | 100% | 31.57 | 60.22 |
| AAT | 0% | | |
| DTP-1 | 95% | 51.16 | 74.43 |
| AAT | 5% | | |
| DTP-1 | 90% | 49.5 | 71.27 |
| AAT | 10% | | |
| AAT | 100% | — | 60.51 |
| | | Set B | |
| DTP-1 | 100% | 53.64 | 73.21 |
| AAT | 0% | | |
| DTP-2 | 100% | 56.6 | 73.53 |
| AAT | 0% | | |

TABLE I-continued

| Collectors | | Recovery to Concentrate 1 | Recovery to Concentrate 1 + 2 |
|---|---|---|---|
| DTP-1 | 95% | 63.82 | 80.74 |
| AAT | 5% | | |
| DTP-1 | 90% | 58.47 | 74.21 |
| AAT | 10% | | |
| | | Set C | |
| DTP-2 | 100% | 61.71 | 79.65 |
| AAT | 0% | | |
| DTP-1 | 95% | 64.87 | 82.62 |
| AAT | 5% | | |
| DTP-1 | 90% | 63.41 | 80.01 |
| AAT | 10% | | |

DTP(1) = Diisobutyldithiophosphate
DTP(2) = Commercial diisobutyldithiophosphate
AAT = N-allyl-o-isobutylthionocarbamate This data demonstrates the improvement in rate (to Con. 1) and overall recovery (Con. 1+2) achieved by the replacement of diisobutyldithiophosphate with a blend of diisobutyldithiophosphate and N-allyl-o-isobutylthionocarbamate. Synergism is demonstrated by the complete replacement of the diisobutyldithiophosphate with the N-allyl-o-isobutylthionocarbamate.

EXAMPLE 2

A PGM and gold ore is reduced in particle size to typical flotation size by accepted means and conditioned with copper sulphate modifier Collector mixtures, other modifiers and frothers are added thereto and the value fraction is recovered by flotation.

The procedure is as follows Samples of ore are removed from the system by accepted means and reduced to minus 4.0mm. Each ore sample is separated into fractions by means of a sample splitter to ensure equal and representative fractions for further grinding. The ore is ground to 66% −74 microns After grinding, the ore is transferred by accepted means to a Denver flotation machine and diluted to a solids density of approximately 35%. The rotor is set to 900 rpm with the air valve closed and freshly prepared reagents are added as follows: Copper sulphate modifier 45 gpt, condition for 5 minutes; collectors, (xanthate 40 gpt), condition for 1.0 minute; Depressant 300 gpt, condition 1.0 minute; Frother 40 gpt, condition 0.5 minute. The rotor rpm is increased to 1300, air is opened and Concentrate 1 is collected for 1 minute. Concentrate 2 is then collected for 3 minutes (total 4 minutes) and concentrate 3 is collected for 8 minutes (total 12 minutes). Concentrate (3) and the tailings are then filtered, dried and processed for PGM and gold analysis The results are set forth in Table II, below.

TABLE II

| Collectors | | Recovery to Concentrate 1 | Recovery to Concentrate 1 + 3 |
|---|---|---|---|
| AAT | 40 gpt | 47.49 | 75.93 |
| DTP | 0 gpt | | |
| AAT | 30 gpt | 59.29 | 79.43 |
| DTP | 10 gpt | | |
| AAT | 20 gpt | 45.13 | 71.29 |
| DTP | 20 gpt | | |
| AAT | 10 gpt | 57.16 | 84.63 |
| DTP | 30 gpt | | |
| AAT | 5 gpt | 61.10 | 88.49 |
| DTP | 35 gpt | | |
| AAT | 0 gpt | 59.97 | 82.65 |
| DTP | 40 gpt | | |

DTP = diisobutyldithiphosphate
AAT = N-allyl-o-isobutylthionocarbamate

This data set demonstrates the improvement in rate (to Con. 1) and overall recovery (Con. 1+3) achieved by the replacement of a dithiophosphate with a blend if dithiophosphate and allyl alkylthionocarbamate. Synergism is clearly demonstrated.

EXAMPLES 3-7

Following the procedure of Example 1 various mixtures of dithiophosphates and allylalkylthionocarbamates falling within the scope of this invention are tested as precious metal and collectors on gold and other ores. The compositions and other variables are set forth in Table III, below. Similar results are achieved.

TABLE III

| Ex. | Dithiophosphate Collector (A) R | X | Thionocarbamate Collector (B) R | Primary Ore Metal | Auxilliary Collector | Volume Ratio A:B |
|---|---|---|---|---|---|---|
| 3 | ethyl | Na | isobutyl | Au | MBT | 80:20 |
| 4 | t-butyl | $NH_4$ | ethyl | Pt/Pd | TU | 20:80 |
| 5 | cyclo-hexyl | K | isobutyl | Au | DTC | 65:35 |
| 6 | i-butyl | Na | n-octyl | Au | none | 10:90 |
| 7 | m-octyl | Na | ethyl | Au | DTP | 35:65 |

TU = thiourea
MBT = mercaptobenzothiazole
DTC = dithionocarbamate (commercial)
DTP = dithiophosphate (commercial)

We claim:

1. In a froth flotation process for beneficiating a gold, solver or platinum group ore comprising slurrying liberation-sized particles of said ore in an aqueous medium, conditioning the resultant slurry with effective amounts of a frothing agent and a collector, respectively, and floating the desired gold, silver or platinum group containing mineral by froth flotation methods, the improvement comprising: employing, as the collector, at a pH of neutral to alkaline, from about 75-95%, by weight, of at least one dithiophosphate compound of the formula:

$$(RO)_2PS^{-}X^{+} \quad \text{(I)}$$

and from about 5-25%, by weight, of at least one allylalkylthionocarbamate of the formula:

$$CH_2{=}CHCH_2NHC(=S)-OR$$

wherein each R is, individually, an $C_2$-$C_8$ alkyl radical and X is a cation and selectively recovery the gold, silver or platinum group metal therefrom.

2. The process of claim 1 wherein said collector is added in an amount of from about 0.005 to about 0.5 lb/ton of ore.

3. The process of claim 1 wherein said aqueous slurry of liberation-sized ore particles has a pH value of from about 7.0 to about 12.0.

4. The process of claim 1 wherein each R is isobutyl.

5. The process according to claim 1 wherein said dithiophosphate and said thionocarbamate is employed in conjunction with an auxiliary collector.

6. The process according to claim 5 wherein said auxiliary collector is selected from xanthates, dithiophosphinates, dithionocarbamates, thioureas and mercaptobenzothiazoles.

* * * * *